US005271984A

United States Patent [19]

Johnson et al.

[11] Patent Number: 5,271,984

[45] Date of Patent: * Dec. 21, 1993

[54] METHOD OF MANUFACTURING A DECORATIVE RIBBON WITH WIRE THREAD AND PRODUCT

[75] Inventors: R. Thurman Johnson, Blowing Rock; Hal G. Johnson, Boone, both of N.C.

[73] Assignee: Ribbon Textiles, Inc., Boone, N.C.

[ * ] Notice: The portion of the term of this patent subsequent to Jan. 11, 2007 has been disclaimed.

[21] Appl. No.: 3,026

[22] Filed: Jan. 11, 1993

[51] Int. Cl.[5] ..... B32B 9/00

[52] U.S. Cl. ..... 428/102; 428/4; 428/5; 428/123; 428/152; 156/91; 156/93; 112/417

[58] Field of Search ..... 428/4-5, 428/102, 123; 156/91, 93; 112/417

[56] References Cited

U.S. PATENT DOCUMENTS

| | | | |
|---|---|---|---|
| 4,366,199 | 12/1982 | Grosjean | 428/4 X |
| 4,585,676 | 4/1986 | DeSmet | 428/5 |
| 4,634,612 | 1/1987 | Nelson | 428/4 |
| 4,963,411 | 10/1990 | Protz, Jr. | 428/123 |
| 5,145,725 | 9/1992 | Johnson et al. | 428/102 |

*Primary Examiner*—Patrick J. Ryan
*Assistant Examiner*—Abraham Bahta
*Attorney, Agent, or Firm*—W. Thad Adams, III

[57] ABSTRACT

A method of manufacturing a decorative ribbon, including the steps of gathering an elongate ribbon, stitching the ribbon along the length thereof while gathered with wire thread to hold the ribbon in the gathered condition. The ribbon may also be heat set while held in the gathered condition by the wire stitches. A ribbon according to the method is also disclosed.

11 Claims, 4 Drawing Sheets

METHOD OF MANUFACTURING A DECORATIVE RIBBON WITH WIRE THREAD AND PRODUCT

TECHNICAL FIELD AND BACKGROUND OF THE INVENTION

This invention relates to a method of manufacturing a decorative ribbon or the like and a decorative ribbon product made according to the method. Ribbons made according to the method described in this application incorporate a wire thread to assist in maintaining the gathered condition of the ribbon, and can be used for wrapping gift packages, making decorative bows and other trimming for packages and as hair accessories, trimming and otherwise decorating apparel, home furnishings and Christmas trees, other party and holiday decorations, and for many other purposes. The ribbon may additionally be heat-set, or the wire itself may serve to provide all of the support to the gathers.

The term "ribbon" is used in this application in a broad sense to mean "a long narrow strip resembling a ribbon." See Webster's Seventh New Collegiate Dictionary, (G. & C. Merriam, 1972). The ribbon product described in this application may be fabricated of any long narrow strip material otherwise suitable for use, such as a woven ribbon material, slit films such as Mylar polyester film or lace. The ribbon material may be thermoplastic or coated with a heat setting resin.

Gathered decorative ribbons are known in the prior art. See, applicant's prior U.S. Pat. No. 5,145,725. However, ribbons of the general type disclosed in this application have heretofore been gathered on a sewing machine using cotton or synthetic textile thread, such as polyester monofilament. When the stitches break or pull out, the gathers release. In the above-referenced '725 Patent, the ribbon was heat-set after stitching to set the thermoplastic material of the thread and ribbon. Thus, if the stitching comes loose, the "set" in the ribbon itself holds the ribbon in shape.

It is known to incorporate wire into a decorative ribbon. However, these prior art ribbons insert the wire into the edges of the ribbon, and the wire is used to shape the ribbon into bends, bows or the like during use. The ribbon itself is sold flat. Insofar as applicant is aware, wire has not heretofore been used to gather ribbon and to assist in holding the gathered shape of the ribbon.

The invention described in this application provides an easy way of providing a decorative ribbon which is easy to use, can be washed repeatedly without losing the gathered appearance, and can be further processed to provide a much wider variety of appearances. The ribbon may be heat set after stitching with wire, or sold and used without heat setting.

SUMMARY OF THE INVENTION

Therefore, it is an object of the invention to provide a method of manufacturing a decorative ribbon which has permanently set gathering by means of wire stitched into the ribbon during gathering.

It is another object of the invention to provide a method of manufacturing a decorative ribbon which maintains the gathered appearance even if the gathering stitches break or are removed.

It is another object of the invention to provide a method of manufacturing a decorative ribbon which can be gathered and otherwise processed to present many differing appearances held in place only by wire thread and heat setting, or only by wire thread.

It is another object of the invention to provide a method of manufacturing a decorative ribbon which results in a ribbon having permanent characteristics of many different varieties.

These and other objects of the present invention are achieved in the preferred embodiments disclosed below by providing a method of manufacturing a decorative ribbon, comprising the step of gathering an elongate ribbon, stitching the ribbon along the length thereof with wire thread while gathered to hold the ribbon in the gathered condition. The gathered ribbon may optionally be heat set while held in the gathered condition by the stitches to ad further permanence to the gathers in the ribbon.

According to one preferred embodiment of the invention, the invention includes the steps of winding the gathered ribbon onto a mandrel before heat setting the ribbon, heat setting the ribbon while the ribbon is wound onto the mandrel to place an axially repeating permanent twist into the ribbon, and removing the heat set ribbon from the mandrel.

According to another preferred embodiment of the invention, the steps of gathering and stitching with wire thread take place simultaneously as the ribbon is processed through a differential feed sewing machine.

According to yet another preferred embodiment of the invention, the wire stitching is applied along the center line of the ribbon generally equidistant two opposing side edges of the ribbon.

According to yet another preferred embodiment of the invention, the wire stitching is applied asymmetrically along the ribbon closer to one side edge than the other side edge.

According to yet another preferred embodiment of the invention, the ribbon is formed of a thermoplastic material.

According to yet another preferred embodiment of the invention, the ribbon is a woven fabric ribbon formed from a thermoplastic material.

According to yet another preferred embodiment of the invention, the ribbon is a slit film ribbon formed from a thermoplastic material.

According to yet another preferred embodiment of the invention, the ribbon comprises a lace ribbon formed from a thermoplastic material.

Preferably, the ribbon is gathered with a shirr ratio in the range of between 1.25 to 1 and 5 to 1.

According to another preferred embodiment of the invention, the ribbon is gathered with a shirr ratio in the range of between 2.5 to 1 and 10 to 1.

The product according to the invention results from the practice of the method.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
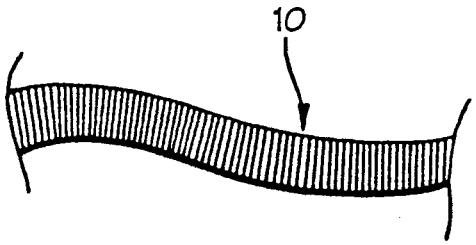
FIG. 1 shows a short section of a flat woven ribbon with which the method according to a preferred embodiment of the invention can be practiced and from which a product according to a preferred embodiment of the invention can be made.

Referring now specifically to the drawings, a woven flat ribbon material according to which the ribbon according to the present invention can be made is illustrated in FIG. 1 and shown generally at reference numeral 10. Ribbons made from grosgrain, satin weave material, printed or woven stripes, ribbons fabricated from non-woven strips and many other types of ribbons can also be used.

Preferably the ribbon is made from a thermoplastic material such as 100% polyester or nylon is used, which when deformed, heated above a certain temperature and cooled in the deformed position, permanently retains the deformed position.

Alternatively, a ribbon which is not thermoplastic but which is coated or impregnated with a thermosetting resin may be used.

Figure 2:
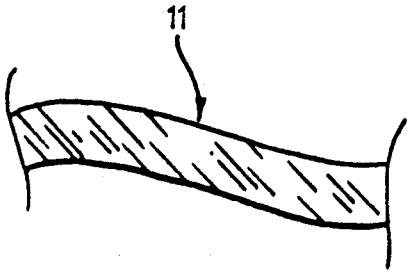
FIG. 2 shows a short section of a flat slit film with which the method according to a preferred embodiment of the invention can be practiced and from which a product according to another preferred embodiment of the invention can be made.

As is shown in FIG. 2, a slit polyester film ribbon 11 may also be used.

The ribbon according to the invention is constructed by first running the ribbon 10 or 11 through a sewing machine with a differential feed attachment. The sewing machine is set to a predetermined shirr ratio, meaning that the ribbon is gathered by feeding ribbon into the sewing machine at a given ratio faster than it is fed out of the sewing machine. If the ribbon is fed into the machine two and one-half times faster than it is fed out of the machine, the shirr ratio is "2.5 to 1" and the resulting gathered ribbon resembles the gathered ribbons 12, 13 and 14 shown in FIGS. 3, 4 and 5.

The stitches inserted by the sewing machine hold the gathers in place. If the stitching is removed, the length of the ungathered ribbon is two and one-half times longer than the gathered ribbon. Shirr ratios between 1.25 and 10 to 1 are possible and will create different appearances in the gathered ribbon. The degree to which the ribbon can be gathered depends on the thickness and flexibility of the ribbon.

Figure 6:
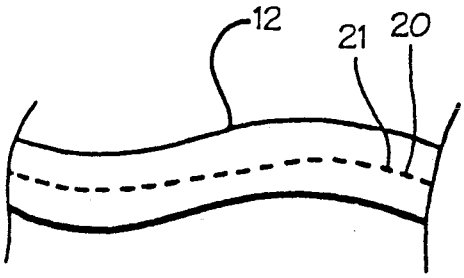
FIGS. 6, 7 and 8 show the stitching arrangement of three embodiments of the ribbon product, with the gathering omitted to show the stitching position along the centerline of the ribbon (FIG. 6), along one side edge of the ribbon (FIG. 7), and a centerline zig-zag stitch (FIG. 8)
Figure 7:
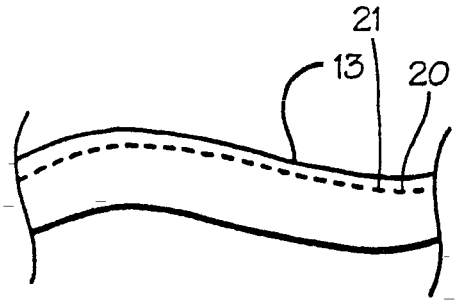
Figure 8:
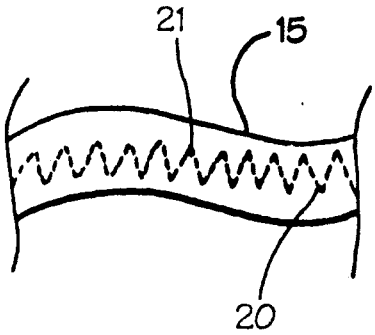

Different decorative effects can be achieved by varying the placement of the stitches. As is shown in FIG. 6, the stitches may be inserted down the centerline of the ribbon 12, giving the effect shown in FIG. 3. Placing the stitches asymmetrically along one side edge of the ribbon 13 as is shown in FIG. 7 will result in a different appearance with the gathered ribbon having broader, more fan-like gathers on one side as is shown in FIG. 4. Using zig-zag stitches on ribbon 15 as shown in FIG. 8 will result in a gathered ribbon having gathers of different depths. As noted above, the gathers have been removed from the ribbons shown in FIGS. 6, 7 and 8 in order to illustrate the stitching.

Figure 9:
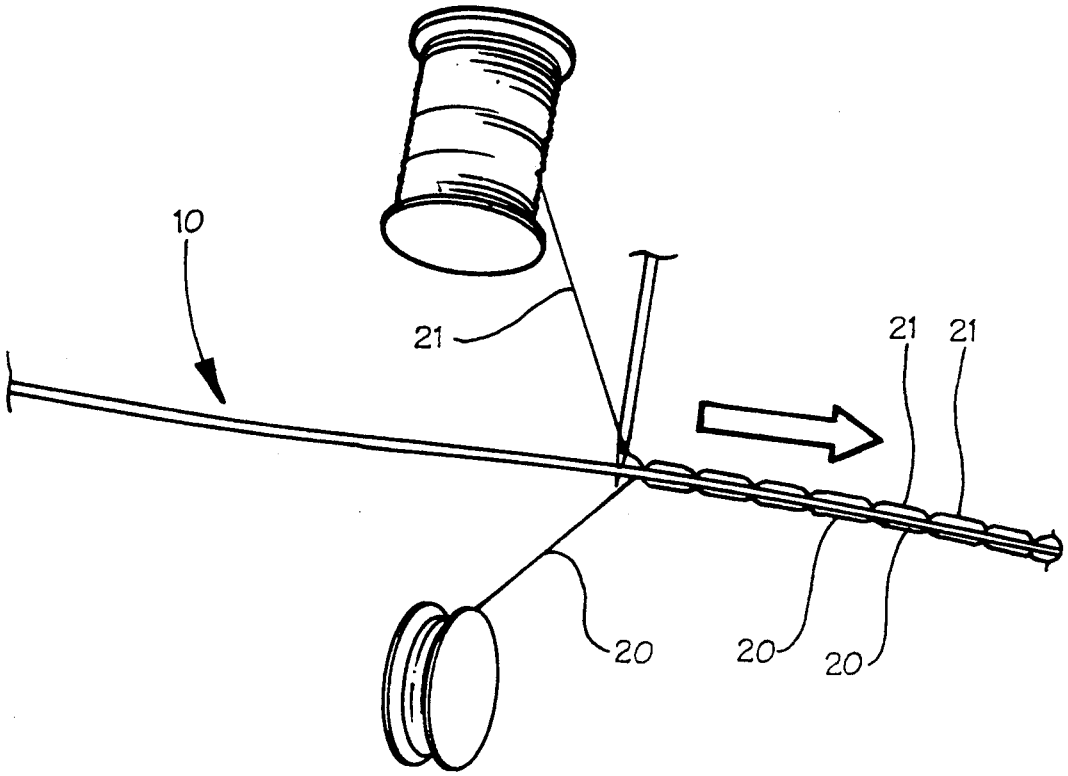
FIG. 9 schematically illustrates the step of sewing the wire stitches into the ribbon, with the ribbon flattened for clarity.

In accordance with a preferred embodiment of the invention, the sewing machine is set up to use a wire thread as the bobbin thread, and a monofilament thread such as polyester is used as the needle thread. As is best shown in FIG. 9, a wire thread 20 is fed from the bobbin of the sewing machine, and a polyester monofilament thread 21 is fed from the spool of the sewing machine to the needle. In accordance with conventional sewing technique, the bobbin and needle threads 20 and 21 interlock between stitches to bind each of the threads into the ribbon 10. In a preferred embodiment, a 32 gauge steel wire thread is used. This wire has a memory which keeps the thread in its bent and/or twisted state once inserted into the ribbon 10 unless and until the wire thread 20 is pulled sufficiently hard to straighten it. In practice, the amount of pull needed to straighten the wire thread 20 once it is stitched into the ribbon 10 and bound in place to the polyester thread 21 is sufficiently great that the wire in fact holds the ribbon 10 in its gathered position. For this reason, for many applications is unnecessary to heat set the ribbon 10 after gathering and stitching with the wire thread.

Other gauges of wire, and other wire materials may be used depending on the desired end product. In addition, both the bobbin and needle threads may be wire, with either the same wire being used for both, or different wires being used for each.

Many other variations in stitching can be used to vary the appearance and function of the ribbon 10. The stitches per inch inserted into the ribbon have a substantial effect on the appearance of the ribbon. Different stitches such as straight, zig-zag, overedge seaming, smocking, shell, lock and chain stitches produce varying appearances, as does the use of two or more rows of parallel stitching.

After gathering the ribbon may optionally be heat set. If this is desired, the ribbon 10 is arrayed onto a large tray or similar device and placed into a heat setting oven. The time and temperature are determined based on the type of material from which the ribbon is made and the dyestuff used to dye the ribbon. The ribbon is heated to the point where the plastic memory of the thermoplastic ribbon is released. Then, the ribbon is cooled, resetting the plastic memory of the ribbon and the thermoplastic gathering thread in the gathered condition. The memory and the condition of the wire thread 20 is completely unchanged, since the wire has a plastic memory many times higher than the relatively low seating temperature of the thermoplastic ribbon 10 and thread 21.

If a ribbon with a thermosetting resin is used, the heat temperature and time is adjusted for the cure temperature and time of the resin. In either case, the resulting ribbon has a permanently set gather, so that even if the gathering thread or threads eventually break, the ribbon holds its shape. The ribbon may be washed repeatedly without losing its gathered appearance.

Figure 3:
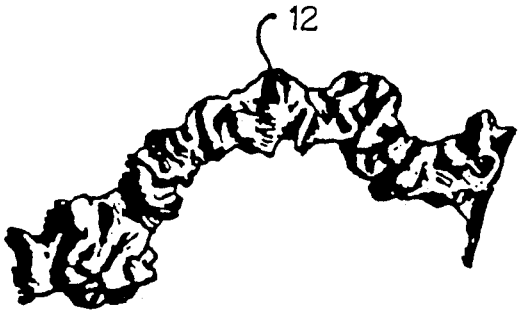
FIG. 3 shows the product according to one embodiment of the invention with a single row of gathering stitches along the centerline of the ribbon.
Figure 4:
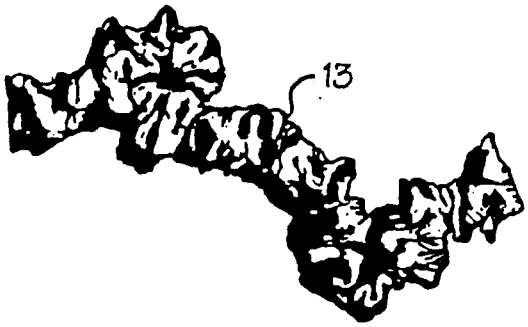
FIG. 4 shows the product according to another embodiment of the invention with a single row of gathering stitches along one side edge of the ribbon.

To produce a ribbon 12 or 13 such as shown in FIGS. 3 and 4, respectively, the heat set ribbon is then packaged according to preference by cutting to length, reeling onto a dispensing tube, packaging in bulk in bags or boxes or in other desired ways.

Figure 10:
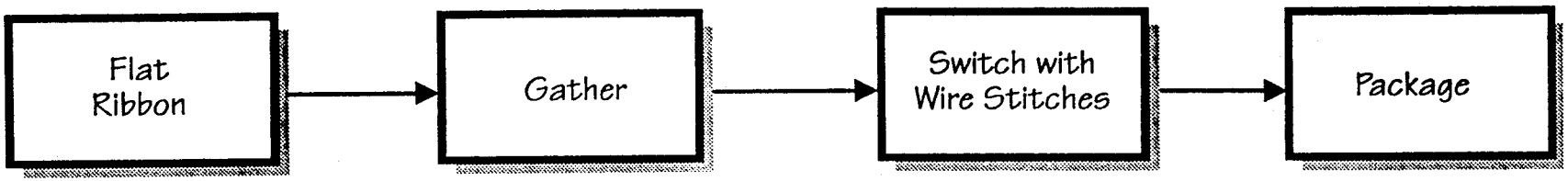
FIG. 10 is a flow diagram of the steps of the method according to one embodiment of the invention.

The method described above is illustrated in schematic form in FIG. 10.

Figure 5:
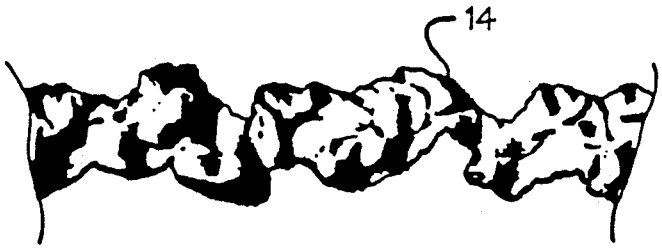
FIG. 5 shows the product according to another embodiment of the invention wherein the ribbon was wrapped around a cylindrical mandrel after gathering and before heat setting to impart a longitudinal, helical twist to the ribbon.

Further variations in the appearance of the ribbon may be achieved by introducing further random or repeating variations into the ribbon before heat setting. The ribbon shown in FIG. 5 illustrates the appearance of the ribbon shown in FIG. 3 if, before heat setting, the ribbon is wound around a cylindrical mandrel to impart a spiral twist into the ribbon. The mandrel with the ribbon 14 wound thereon is then placed into the heat setting oven as described above. After cooling, the ribbon 14 is removed from the mandrel. As shown in FIG. 5, the resulting product not only has permanently set gathers as in FIG. 3, but is additionally set into a permanent spiral, or helical, twist. The ribbon 14 has a high degree of "spring" which permits the ribbon to be elongated and then released, whereupon the ribbon 14 returns to its relaxed length. Oval, square or triangular mandrels may also be used as the case may be. In each case, the ribbons assume a springy, spiral configuration, but with a slightly different relaxed appearance. Wood, such as in the form of a dowel, makes a suitable mandrel.

The term mandrel is used in a broad sense to mean a support which holds the ribbon in a given shape and position during heating. Racks, frames and other structures could be also be used so long as a random or repeating arrangement of the ribbon is achieved and maintained during heat setting.

Figure 11:
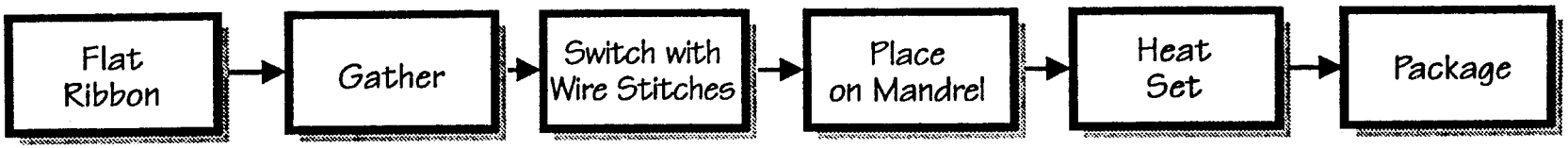
FIG. 11 is a flow diagram of the steps of the method according to another embodiment of the invention.

The method described immediately above is illustrated in schematic form in FIG. 11.

EXAMPLE ONE

The ribbon material from which ribbon 12 was made is a 3/8" wide 100% polyester woven ribbon.

Ribbon 12 shown in FIG. 3 was made on a Model 400W31 sewing machine with a differential feed attachment feeding at a shirr ratio of 2.5 to 1. Twenty-four lock stitches per inch of monofilament galvanized steel wire 20 and polyester thread 21 was used. Thirty-two gauge steel wire was used in the bobbin and number 17 polyester thread in the needle. Machine rpm was set at between 3300 to 3500. The resulting ribbon 12 was gathered, with the steel wire thread 20 holding the gathers in place along the stitching itself. Heat setting is not necessary.

EXAMPLE TWO

The ribbon material from which ribbon 12 was made is a 3/8" wide 100% polyester woven ribbon.

Ribbon 12 shown in FIG. 3 was made on a Model 400W31 sewing machine with a differential feed attachment feeding at a shirr ratio of 2.5 to 1. Twenty-four lock stitches per inch of monofilament steel wire 20 and polyester thread 21 was used. Thirty-two gauge galvanized steel wire was used in the bobbin and number 17 polyester thread in the needle. Machine rpm was set at between 3300 to 3500. The resulting ribbon 12 was gathered, with the steel wire thread 20 holding the gathers in place along the stitching itself.

The gathered ribbon was arrayed on a large flat tray and placed in a walk-in heating oven at 350 for 20 minutes. Ribbons dyed with other dyestuffs may require heating up to 30 minutes. The range within which heat setting will ordinarily occur is between 10 and 30 minutes.

EXAMPLE THREE

The ribbon material from which ribbon 12 was made is a 3/8" wide 100% polyester woven ribbon.

Ribbon 12 shown in FIG. 3 was made on a Model 400W31 sewing machine with a differential feed attachment feeding at a shirr ratio of 2.5 to 1. Twenty-four lock stitches per inch of monofilament steel wire 20 and polyester thread 21 was used. Thirty-two gauge galvanized steel wire was used in the bobbin and number 17 polyester thread in the needle. Machine rpm was set at between 3300 to 3500. The resulting ribbon 12 was gathered, with the steel wire thread 20 holding the gathers in place along the stitching itself.

The gathered ribbon was arrayed on a large flat tray and placed in a walk-in heating oven at 350 for 20 minutes. Ribbons dyed with other dyestuffs may require heating up to 30 minutes. The range within which heat setting will ordinarily occur is between 10 and 30 minutes.

The ribbon 14 was placed on a ¼" diameter wooden dowel rod which served as the mandrel. The resulting ribbon has gathers held in place by the stitches, by the wire stitches, and by the heat setting effect on the ribbon itself and the polyester stitches.

A method of manufacturing a decorative ribbon or the like and a decorative ribbon product made according to the method is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A decorative ribbon, comprising an elongate gathered ribbon having wire sewing sewn into said ribbon along its length while the ribbon is in a gathered condition to hold the gathers of the ribbon in their gathered condition.

2. A decorative ribbon according to claim 1, wherein the ribbon includes gathers held in place by stitching with said wire and by heat setting.

3. A decorative ribbon according to claim 1, the sewing stitches are formed by a pair of interlocking threads, one of said threads comprising said wire, and the other of said thread comprising a synthetic monofilament textile sewing thread.

4. A decorative ribbon according to claim 1, wherein the wire stitches extend along the center line of the ribbon generally equidistant two opposing side edges of the ribbon.

5. A decorative ribbon according to claim 1, wherein the stitching extends asymmetrically along the ribbon closer to one side edge than the other side edge.

6. A decorative ribbon according to claim 1, wherein the ribbon is formed of a thermoplastic material.

7. A decorative ribbon according to claim 1, wherein the ribbon is a woven fabric ribbon formed from a thermoplastic material.

8. A decorative ribbon according to claim 1, wherein the ribbon is a slit film ribbon formed from a thermoplastic material.

9. A decorative ribbon according to claim 1, wherein the ribbon comprises a lace ribbon formed from a thermoplastic material.

10. A decorative ribbon according to claim 1, wherein the ribbon is gathered with a shirr ratio in the range of between 1.25 to 1 and 5 to 1.

11. A decorative ribbon according to claim 1, wherein the ribbon is gathered with a shirr ratio in the range of between 2.5 to 1 and 10 to 1.

* * * * *

UNITED STATES PATENT AND TRADEMARK OFFICE

CERTIFICATE OF CORRECTION

PATENT NO. : 5,271,984

DATED : December 21, 1993

INVENTOR(S) : JOHNSON, Thurman R. and JOHNSON, Hal G.

It is certified that error appears in the above-identified patent and that said Letters Patent is hereby corrected as shown below:

Cover page, left-hand column after item [73] Assignee, insert the following:

[ * ] Notice:

Correct the Statement to read

--The portion of the term of this patent subsequent to September 8, 2009 has been disclaimed.--

Signed and Sealed this

Seventeenth Day of May, 1994

*Attest:*

BRUCE LEHMAN

*Attesting Officer*

*Commissioner of Patents and Trademarks*